United States Patent [19]

Moreno et al.

[11] Patent Number: 4,706,612

[45] Date of Patent: Nov. 17, 1987

[54] TURBINE EXHAUST FED LOW $NO_x$ STAGED COMBUSTOR FOR TEOR POWER AND STEAM GENERATION WITH TURBINE EXHAUST BYPASS TO THE CONVECTION STAGE

[75] Inventors: Frederick E. Moreno, Los Altos; Creighton D. Hartman, San Francisco, both of Calif.

[73] Assignee: PruTech II, San Jose, Calif.

[21] Appl. No.: 17,484

[22] Filed: Feb. 24, 1987

[51] Int. Cl.[4] ..... F22D 1/00

[52] U.S. Cl. ..... 122/7 R; 60/39.182; 122/470

[58] Field of Search ..... 122/1 R, 7 R, 470; 60/39.182

[56] References Cited

U.S. PATENT DOCUMENTS

| | | | |
|---|---|---|---|
| 2,970,434 | 2/1961 | Warren | 60/39.182 |
| 3,053,049 | 9/1962 | Blaskowski | 122/7 R X |
| 3,561,405 | 2/1971 | Tramuta | 122/7 R |
| 4,353,207 | 10/1982 | Lee | 60/39.182 |
| 4,466,241 | 8/1984 | Inui et al. | 60/39.182 |
| 4,572,110 | 2/1986 | Haeflich | 122/7 R |

*Primary Examiner*—Edward G. Favors
*Attorney, Agent, or Firm*—Harry E. Aine

[57] ABSTRACT

In a low $NO_x$ power and steam generator for thermally enhanced oil recover, a gas turbine fired with nitrogen-bearing crude oil and air produces power and hot turbine exhaust. A portion of the turbine exhaust is fed into the primary combustion chamber of a two-stage combustor for supplying the combustion air for burning a high nitrogen-containing crude oil in the primary combustion zone under fuel-rich conditions. The combustion is completed in a secondary combustion zone supplied with air derived from a second portion of the turbine exhaust at about 1200° F. A third portion of the turbine exhaust is fed into a convection stage disposed to receive the exhaust from the secondary combustion zone for capturing the heat from the turbine exhaust and from the exhaust of the secondary zone and converting it to steam. The output exhaust flow from the turbine is relatively constant with time, whereas the steam requirements for oil recovery decrease with time as production falls off and, thus, means are provided for bypassing an increasing percentage of the turbine exhaust around the two-stage combustor for heat recovery in the convection stage.

3 Claims, 1 Drawing Figure

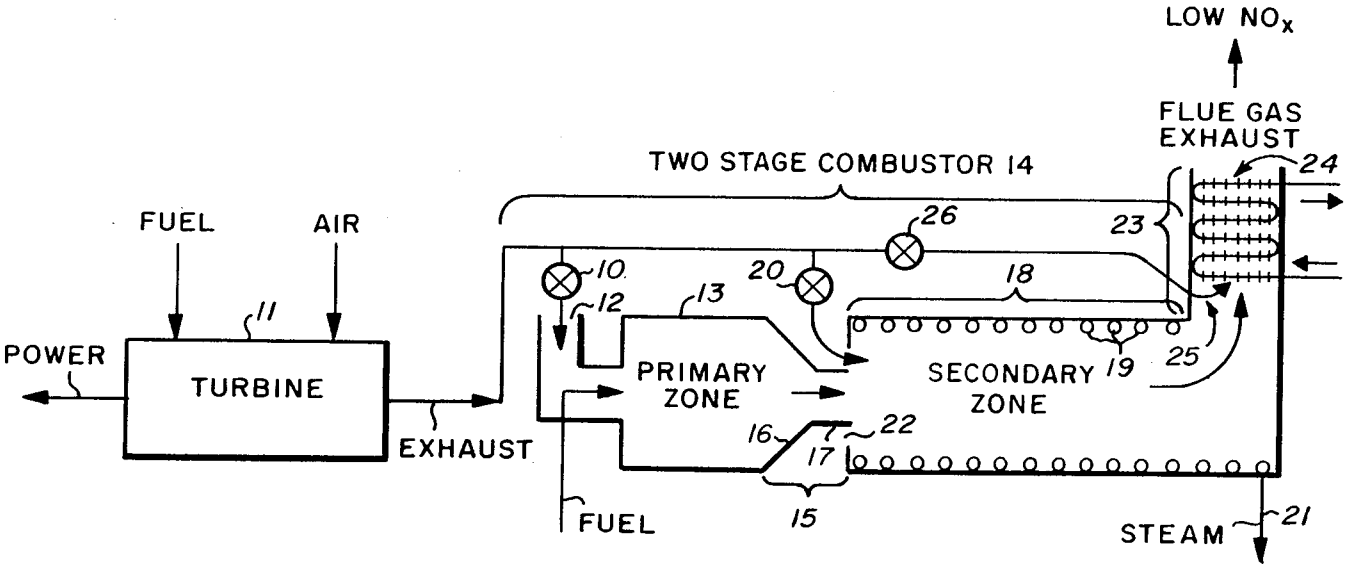
LOW $NO_x$
FLUE GAS EXHAUST
24
TWO STAGE COMBUSTOR 14
23
18
26
20
13
10
12
25
19
SECONDARY ZONE
PRIMARY ZONE
22
17
16
15
21
STEAM
FUEL
EXHAUST
AIR
FUEL
11
TURBINE
POWER

TURBINE EXHAUST FED LOW $NO_x$ STAGED COMBUSTOR FOR TEOR POWER AND STEAM GENERATION WITH TURBINE EXHAUST BYPASS TO THE CONVECTION STAGE

BACKGROUND OF THE INVENTION

The present invention relates in general to low $NO_x$ thermally enhanced oil recovery power and steam generation wherein the exhaust from a gas turbine, utilized to generate power, provides combustion air to the primary and secondary combustion chambers of a staged combustor and, in addition, a variable portion of the turbine exhaust is bypassed to the convection stage of the steam generator.

DESCRIPTION OF THE PRIOR ART

Thermally enhanced oil recovery (TEOR) processes are applied to oil field production in order to extract heavy, viscous, crude oil and tar sands which cannot otherwise be produced. TEOR involves injection of wet steam, which is produced by combusting crude oil in an oil field steam generator typically ranging in size from 7–15 MW capacity. More than 90% of all oil field steam generators in the U.S. are located in California, two-thirds (approximately 1,000 units) of which are located in Kern County. Approximately one-third of the produced crude oil is consumed by the steam generator, amounting to over 100,000 barrels of crude oil consumed per day at full capacity. The crude oils which are fired in these steam generators are typically high in nitrogen ($\approx$0.82 to 1.0%) and sulfur content. Uncontrolled emissions of $NO_x$ can, therefore, reach high levels and potentially worsen ambient air quality.

Emissions of $NO_x$ can be minimized by application of a staged combustion process in which the first or primary combustion stage is thermally isolated and provides long residence time under high temperature, optimally fuel-rich conditions. Combustion products, resulting from the first stage combustion process, are fed into a secondary combustor in which additional air is added to complete the combustion process.

It has been proposed to combine a power production stage in the form of a gas turbine, fired with the crude oil and air, ahead of the staged combustor and to use the exhaust of the turbine as the supply of combustion air to the primary and secondary combustion stages.

Steam is generated by running water through boiler pipes lining the interior surface of the second stage combustor and by running water through finned boiler pipes in a convection stage which follows the second stage combustor. The exhaust temperature at the output of the convection stage is approximately 400° F., whereas the turbine exhaust is approximately 1200° F. and temperatures in the primary and secondary combustion combustors are on the order of 2800° to 3000° F.

As the oil field matures, production drops off and the steam requirements are reduced. However, the gas turbine is designed for a more or less fixed rate of exhaust flow so that a problem arises as to how to handle the excess turbine exhaust when the staged combustor is turned down commensurate with the reduced steam demand.

SUMMARY OF THE PRESENT INVENTION

The principal object of the present invention is the provision of an improved, low $NO_x$ power and steam generator for thermally enhanced oil recovery, and, more particularly to such a co-generating system providing efficient operation while reducing the rate of steam generation.

In one feature of the present invention, a portion of the hot turbine exhaust gas is bypassed around the first and second combustion stages of the combustor into the convection stage so that the turbine exhaust flow rate may be maintained relatively constant while reducing the rate of turbine exhaust flow and fuel flow into the first and second stages of the combustor to allow for a reduction in the rate of steam generation.

In another feature of the present invention, the percentage of the turbine exhaust which is bypassed around the first and second combustion stages to the convection stage is increased over the operating life of the oil field to allow for a reduced rate of steam generation and oil production encountered in the oil field.

Other features and advantages of the present invention will become apparent upon a perusal of the following specification taken in connection with the accompanying drawings wherein:

BRIEF DESCRIPTION OF THE DRAWINGS

The drawing is a schematic, line diagram, partly in block diagram form, of a power and steam generator system for thermally enhanced oil recovery and employing features of the present invention.

DESCRIPTION OF THE PREFERRED EMBODIMENTS

Referring now to the drawing, there is shown a steam and power co-generation system employing a two-stage combustor for use in the oil fields for thermally enhanced oil recovery (TEOR). In this system, a crude oil-fired turbine 11, such as a model TT-1250, commercially available from TurboEnergy Systems, Inc., is coupled to a generator, not shown, for generating electrical power and producing exhaust gases at about 1200° F. containing approximately 15% oxygen. In a typical example, the exhaust flow rate is on the order of 15 pounds per second. A first portion of the turbine exhaust gas is fed via a valve 10 into the air intake 12 of a primary combustion chamber 13 of a two-stage combustor 14 wherein the turbine exhaust is mixed with fuel comprising heavy nitrogen-containing crude oil, such as California crude.

Combustion conditions in the primary combustion chamber 13 are arranged so that the fuel and air in the turbine exhaust burn in the primary combustion chamber in a fuel-rich manner, i.e., with 70% or less stoichiometric oxygen. The turbine exhaust is fed into the primary combustion chamber 13 through a plurality of swirl vanes, not shown, arranged for imparting a moderate swirl, having a swirl number falling within the range of 0.3 to 0.5, to the flow of gases in the primary combustion chamber 13. This causes the primary gas stream to expand to fill the chamber, move through the chamber in plug flow, and to increase its residence time within the primary combustion chamber to approximately 0.5 seconds.

In a typical example, the primary combustion chamber 13 has an inside diameter of approximately 7.5 ft. and a length of approximately 13.5 ft. and includes approximately 10 inches of refractory insulation material lining the interior walls thereof. The flame temperature, within the primary combustion zone, typically reaches temperatures of between 2800° and 2900° F.

The hot combustion gases exit the primary combustion chamber 13 through a transition region 15 which includes a constrictor portion 16 which constricts the diameter of the flow stream. The stream as constricted, then exits through a throat portion 17 into the secondary combustion chamber 18. The secondary combustion chamber 18 includes water boiler pipes 19 lining the interior of the secondary combustion chamber 18 for removing heat from the secondary combustion chamber, primarily by radiation, and for converting the heat into steam which is drawn off at 21.

A second portion of the turbine exhaust is fed, as secondary air, into the entrance to the secondary combustion chamber 18 in a flow pattern coaxially surrounding the outer periphery of the primary gas stream exiting the primary combustion chamber 13 at the exit of the throat 17. The secondary air contains approximately 15% oxygen and is at a temperature of approximately 1200° F. and is fed into the secondary combustion chamber 18 through a plurality of ports 22, coaxially of and disposed around the periphery of the throat portion 17.

A valve 20 in the turbine exhaust feed line to the secondary combustion chamber 18 controls the rate of flow of turbine exhaust into the secondary combustion zone.

In a typical example, the flow-constricting portion 16 of the transition 15 has an axial length approximately 4 ft. and necks the flow down from a diameter of approximately 7.5 ft. to approximately 3 ft., which is the diameter of the throat portion 17. The throat portion 17 has an axial length of between 2 and 3 ft. and the axial velocity of the primary gas stream exiting the primary combustion chamber at the throat 17 is approximately 100 ft. per second.

The turbine exhaust secondary air enters the secondary combustion chamber 18 through eight ports 22, each of which typically has a diameter of 8.7 inches and an axial length of approximately 6 inches. The ports 22 are typically provided in a stainless steel plate lined with a refractory insulative material as of 6 inches in thickness. The ring of secondary air injection ports 22 adds the balance of the combustion air required to complete combustion of the unburned fuel constituents in the exhaust of the primary combustion chamber. Throat region 17 is required to prevent backmixing of secondary air into the primary zone, and to shape the flame in the secondary zone to prevent flame impingement on the walls of the boiler radiant zone or secondary zone.

The hot gases exhausting from the secondary zone 18 are thence fed through a convection section 23 to ultimately exhaust as low $NO_x$ flue gas exhaust. In the convection section 23, finned boiler tubes 24, filled with water, extract heat from the exhaust gases so that the fuel gases exhausting from the convection section exhaust at a temperature of approximately 400° F. Steam is generated in the finned boiler tubes for use in the thermally enhanced oil recovery process.

A third portion of the turbine exhaust is fed into the input to the convection stage 23 at 25 for extracting heat from the turbine exhaust and using that heat to generate steam. A valve 26 is provided in line with the turbine exhaust fed to the convection section 23 for controlling the amount of turbine exhaust bypassing the two-stage combustor 14.

The typical turbine 11 is designed to operate efficiently with a relatively constant exhaust gas flow rate. However, as the thermally enhanced oil recovery oil field matures, oil production tends to drop-off with time and, thus, the steam requirements become less as a function of time. Accordingly, it is desired to reduce the steam production as the oil field matures. This is accomplished by turning down the two-stage combustor 14 by reducing the rate of fuel consumption in the primary combustion chamber 13. In order to maintain the proper burning conditions in the two-stage combustor 14, the turbine exhaust input to the primary and secondary stages 13 and 18, respectively, must be reduced commensurate with the reduction in fuel consumption. The unused turbine exhaust is then bypassed via valve 26 around the two-stage combustor 14 into the convection stage 23 to maintain efficient steam generation while maintaining low $NO_x$ emissions on the order of 100 ppm.

The advantage of the present invention is that it allows the relatively constant turbine exhaust flow to be used efficiently while turning down the two-stage combustor over the lifetime of the oil field while maintaining the low $NO_x$ burner conditions and efficient steam generation. Bypassing the flow of turbine exhaust around the two-stage combustor to the convection stage 23 allows the heat from the unused turbine exhaust gases to be recovered and converted to steam.

What is claimed is:

1. In a low $NO_x$ method for generating power and steam for thermally enhanced oil recovery, the steps of:

firing a gas turbine with a nitrogen-bearing crude oil and air to produce power and hot turbine exhaust gas;

feeding a first portion of the hot turbine exhaust gas together with a nitrogen-bearing crude oil into a primary combustion chamber of a staged combustor for burning the crude oil under fuel-rich conditions to produce hot exhaust gaseous combustion products exiting the primary combustion chamber;

feeding a second portion of the hot turbine exhaust gas together with the hot exhaust gases of the primary combustion chamber into a second combustion chamber lined with water-filled boiler tubes to complete the combustion of the crude oil fed into the primary combustion chamber and to produce steam in said boiler tubes and to produce a stream of hot exhaust gas exiting said second combustion chamber;

feeding a third portion of the hot turbine exhaust gas together with the hot exhaust gas exiting said second combustion chamber into a convection chamber containing finned water-filled boiler pipes for transfer of heat from the turbine exhaust and the exhaust of said second combustion chamber to the water in said boiler pipes to generate steam in said finned boiler pipes; and varying the flow rate of the first portion of the turbine exhaust inversely with the flow rate of the third portion of the exhaust to vary the rate of steam generation, whereby steam is efficiently generated over a wider range of steam generation rates.

2. The method of claim 1 wherein the total turbine exhaust flow rate is held relatively constant as a function of time while the flow rate of the first portion of the turbine exhaust is reduced as a function of time, whereby the rate of steam generation is reduced as a function of time while maintaining efficient steam generation.

3. In a low $NO_x$ power and steam generator for thermally enhanced oil recovery:

gas turbine means for firing with nitrogen-bearing crude oil and air to produce power and hot turbine exhaust gas;

staged combustor means having a primary combustion chamber for burning nitrogen-bearing crude oil with oxygen contained within a first portion of the turbine exhaust gas under fuel-rich conditions to produce hot exhaust gaseous combustion products exiting said primary combustion chamber;

said staged combustor means having a second combustion chamber for burning therein the residual unburned fuel components in the exhaust of said primary combustion chamber with oxygen contained within a second portion of the turbine exhaust as fed into said second combustion chamber;

said second combustion chamber having water-filled boiler tubes therein to produce steam;

convection heat exchanger means disposed to receive the gaseous combustion products of said second combustion chamber together with a third portion of the hot turbine exhaust gases and having water-filled finned boiler tubes therein for extracting heat from the flow of gaseous combustion products flowing therethrough to produce steam; and, means for reducing the ratio of the flow rate of the first portion of the turbine exhaust to the flow rate of the third portion of the turbine exhaust for efficiently reducing the rate of steam generation.

* * * * *